US007452653B2

(12) United States Patent
Tanaka

(10) Patent No.: US 7,452,653 B2
(45) Date of Patent: Nov. 18, 2008

(54) PROCESS FOR PRODUCING POLYMERIZED TONER

(75) Inventor: Katsutomo Tanaka, Tokyo (JP)

(73) Assignee: Zeon Corporation, Tokyo (JP)

( * ) Notice: Subject to any disclaimer, the term of this patent is extended or adjusted under 35 U.S.C. 154(b) by 448 days.

(21) Appl. No.: 10/926,099

(22) Filed: Aug. 26, 2004

(65) Prior Publication Data

US 2005/0048392 A1 Mar. 3, 2005

(30) Foreign Application Priority Data

Aug. 27, 2003 (JP) ..... 2003-302262

(51) Int. Cl.
*G03G 9/093* (2006.01)

(52) U.S. Cl. ..... 430/137.12; 430/137.14; 430/137.17

(58) Field of Classification Search ..... 430/137.14, 430/137.17, 137.15, 137.12
See application file for complete search history.

(56) References Cited

U.S. PATENT DOCUMENTS

2004/0110081 A1* 6/2004 Tanaka et al. ..... 430/137.15

FOREIGN PATENT DOCUMENTS

| | | |
|---|---|---|
| JP | 1-104601 | 4/1989 |
| JP | 5-100485 | 4/1993 |
| JP | 05-289404 | 11/1993 |
| JP | 2001-117272 | 4/2001 |

OTHER PUBLICATIONS

USPTO Trademark Electronic System (TESS) printout describing US trademark Henschel Mixer. registration date Oct. 24, 2000.*

* cited by examiner

*Primary Examiner*—Janis L Dote
(74) *Attorney, Agent, or Firm*—Kratz, Quintos & Hanson, LLP

(57) ABSTRACT

A process for producing a polymerized toner, which comprises steps of forming an aqueous dispersion comprising the colored polymer particles, subjecting the aqueous dispersion comprising the colored polymer particles to stripping treatment in the presence of a nonionic surfactant, dehydrating and washing the aqueous dispersion, wherein washing is carried out by using a washing water a temperature of which is controlled to lower than the cloud point of the nonionic surfactant, drying the wet colored polymer particles, and then getting the colored polymer particles.

17 Claims, 1 Drawing Sheet

PROCESS FOR PRODUCING POLYMERIZED TONER

BACKGROUND OF THE INVENTION

1. Field of the Invention

This invention relates to a process for producing a polymerized toner, more particularly relates to a process for producing a polymerized toner comprising producing a colored polymer particles, which includes a binder resin which is obtained by polymerizing a polymerizable monomer in an aqueous medium and comprises at least a colorant dispersed therein, by polymerization step optionally followed by agglomeration step.

The polymerized toner obtained by the process according to the present invention exhibits excellent characteristic features of charging and imaging. The polymerized toner exhibits excellent characteristic features of toner not only under low temperature and low humidity but also under high temperature and high humidity.

In the present invention, the colored polymer particles are referred as "polymerized toner", the colored polymer particles with added such as an external additive are referred as "developer". The developer may be called "electrophotographic toner" or simply "toner".

2. Description of the Related Art

A developer has been used to visualize electrostatic latent images formed on a photosensitive member in an imaging apparatuses such as laser beam printers and facsimiles and copying machines utilizing electrophotographic or electrostatic recoding principles. The developer is mainly composed of colored particles dispersed with a colorant, a charge control agent and a parting agent in a binder resin.

The colored particles are roughly classified into a pulverized toner obtained by pulverization method and a polymerized toner obtained by polymerization method. The pulverization method fuses and kneads the binder resin, the colorant and the other additive components, and then pulverizes and classifies the kneaded product to give the pulverized toner as colored resin powder. The binder resin is synthesized in advance by polymerization of a polymerizable monomer.

While the polymerization method polymerizes, for example, a polymerizable monomer composition comprising the polymerizable monomer, the colorant and the other additive components in an aqueous medium to give the polymerized toner as colored polymer particles. Suspension polymerization method has been mainly used as such a polymerization method, in addition, other dispersion polymerization and emulsion polymerization methods are also known. The emulsion polymerization method, for example, forms fine particles of resin by emulsion polymerization of the polymerizable monomer in an aqueous medium, and then forms particles having toner particle sizes by chemical agglomeration of a dispersed colorant with an emulsifier and fine particles of resin. The particles are further heated to give spherical colored polymer particles. The emulsion polymerization method requires agglomeration process and is also called as an emulsion polymerizing agglomeration method.

No method completely polymerizes the polymerizable monomer in polymerization process avoiding residue of the unaltered polymerizable monomer in the colored particles and then in the developer. Even a trace amount of residual unaltered polymerizable monomer remaining in the colored particles causes following problems (i) through (v).

(i) The residual polymerizable monomer vaporizes, for example, by heating in fixing process and affects working environment or generates bad odor.

(ii) The residual polymerizable monomer causes blocking of toner during storage.

(iii) The residual polymerizable monomer liable to degenerate fluidity of the toner and affects quality of images.

(iv) The residual polymerizable monomer liable to cause offset.

(v) The residual polymerizable monomer liable to cause filming of the toner on the components of image forming apparatus.

These problems caused by the residual polymerizable monomer are more serious in the polymerized toner than in pulverized toner. The content of the residual polymerizable monomer in the pulverized toner can be easily reduced by heating or drying treatment during the production process of the binder resin.

While the polymerized toner has to remove the residual polymerizable monomer from the colored polymer particles comprising additives such as the colorant, the charge control agent and the parting agent. However, the residual polymerizable monomer is liable to be absorbed in these additives and more difficult to reduce its amount than that in singly used binder resin. In addition, the polymerized toner is liable to agglomerate and restricts the reduction of the residual polymerizable monomer by heat treatment. Recently, requirements for the polymerized toner capable of fixing at lower temperature are increasing to comply with high speed printing or full color printing. However, these low temperature fixing toners are very difficult to reduce the amount of residual polymerizable monomer avoiding agglomeration.

Various countermeasures have been proposed to remove the residual polymerizable monomer from the polymerized toner. For example, blowing of a suspension medium saturated vapor in a suspension comprising the polymerized toner particles (colored polymer particles) after suspension polymerization to distill off the suspension medium was proposed (Japanese Patent Laid-open No. 5-100485). However, the procedure is liable to cause bubbling at the interface between air-suspension solution making stable operation difficult. Furthermore, the procedure often causes problems of declined removal rate of the residual polymerizable monomer due to bubbling and lowered quality of the polymerized toner particles by agglomeration.

A method, in which a silicone de-foaming agent is added to a suspension comprising a polymerized toner particles after polymerization process, and an aqueous medium is distilled off from the suspension while suppressing foaming, was proposed (Japanese Patent No. 2923820). The procedure can remove the residual polymerizable monomer from polymerized toner particles suppressing the foaming at the interface between air and liquid. However, stripping treatment in the presence of a silicone de-foaming agent is liable to cause decline the characteristic features of the obtained polymerized toner. Practically, the polymerized toner obtained by the procedure shows declined charge level and is liable to cause fog and low image density accompanying uneven density.

BRIEF SUMMARY OF THE INVENTION

The object of the present invention is to provide a process for producing a polymerized toner with excellent characteristic features in addition to markedly reduced residual amount of a volatile organic compound such as polymerizable monomer.

More practically, the object of the present invention is to provide a process for producing a polymerized toner having excellent characteristic features of toner by subjecting a aqueous dispersion comprising a colored polymer particles, which is obtained by polymerization step optionally followed by agglomeration step, to stripping treatment in the presence of a nonionic surfactant, thereby markedly reducing the content of a volatile organic compound such as the residual polymerizable monomer (also may be referred as "volatile organic substances" or "volatile substances") and further markedly reducing the residual amount of nonionic surfactant.

The inventers of the present invention dedicatedly investigated to accomplish the aforementioned objects and found that a stable and effective stripping treatment can be performed with effective suppression of foaming at the interface between gas and liquid by subjecting the stripping treatment by adding a nonionic surfactant having a cloud point to an aqueous dispersion comprising a colored polymer particles after the polymerization step optionally followed by the agglomeration step; thereby stripping treatment can markedly reduce the residual amount of the volatile organic compound such as unaltered polymerizable monomer in the colored polymer particles. This process provides the polymerized toner having high charge level, less fog and high image density.

However, presence of a nonionic surfactant in the stripping treatment process may causes scattering of charge in the polymerized toner and fog under elevated temperature and highly humid environment. Therefore, the inventers of the present invention further investigated to solve these problems and found that conventional washing conditions in the art cause substantial amount of residue of nonionic surfactant in the colored polymer particles.

Heretofore, hot water at comparatively high temperature has been used for effective dehydration and washing of the aqueous dispersion comprising the colored polymer particles. Washing waters such as ion exchanged water has often been singly used. Sometimes mixtures of water and an organic solvent may be used for effective washing.

Conventional washing process can effectively removes impurities such as a dispersion stabilizer, however, no sufficient removal of the nonionic surfactant can be accomplished and relatively large amount of its residue remains. It was found that washing with low temperature washing water below the cloud point of the nonionic surfactant can markedly reduce the residual nonionic surfactant remained in the colored polymer particles.

No clear relationship between the temperature of the washing water and the residual amount of nonionic surfactant has been found, however, nonionic surfactant such as polyethylene glycol nonionic surfactant easily forms aggregate (micelle) in an aqueous solution among surfactant and more easily form three dimensional structure of micelle with the elevation of temperature. Particularly, nonionic surfactant suitable for de-foaming agent often shows considerably low HLB value and cloud point and tends to become hardly water-soluble at temperature of not lower than the cloud point. Thus, nonionic surfactant having cloud point forms micelle in three dimensional structures by washing with hot washing water and becomes hardly soluble. While washing water at temperature lower than the cloud point form easily soluble form such as monodispersion and is presumed to increase the removal rate by washing.

The process according to the present invention provides polymerized toner with massively charge level with small dependency on the environmental conditions, high image density and marked suppression of fog not only under ordinary temperature and humidity but also under elevated temperature and humid environment. The present invention is completed on the bases of these findings.

Thus, the present invention provides a process for producing a polymerized toner comprising producing a colored polymer particles, which includes a binder resin which is obtained by polymerizing a polymerizable monomer in an aqueous medium and comprises at least a colorant dispersed therein, by polymerization step optionally followed by agglomeration step, wherein the process comprises the following steps (I) to (IV):

(I) forming an aqueous dispersion comprising the colored polymer particles by the polymerization step optionally followed by agglomeration step;

(II) subjecting the aqueous dispersion comprising the colored polymer particles obtained in step (I) to stripping treatment in the presence of a nonionic surfactant having a cloud point to remove a volatile organic compound which is included in the colored polymer particles;

(III) dehydrating and washing the aqueous dispersion comprising the colored polymer particles after the stripping treatment, wherein washing is carried out by using a washing water at a temperature of which is controlled to lower than the cloud point of the nonionic surfactant; and (IV) filtering the aqueous dispersion comprising the colored polymer particles after washing to obtain a wet colored polymer particles, drying the wet colored polymer particles and then getting the colored polymer particles.

Figure 1:
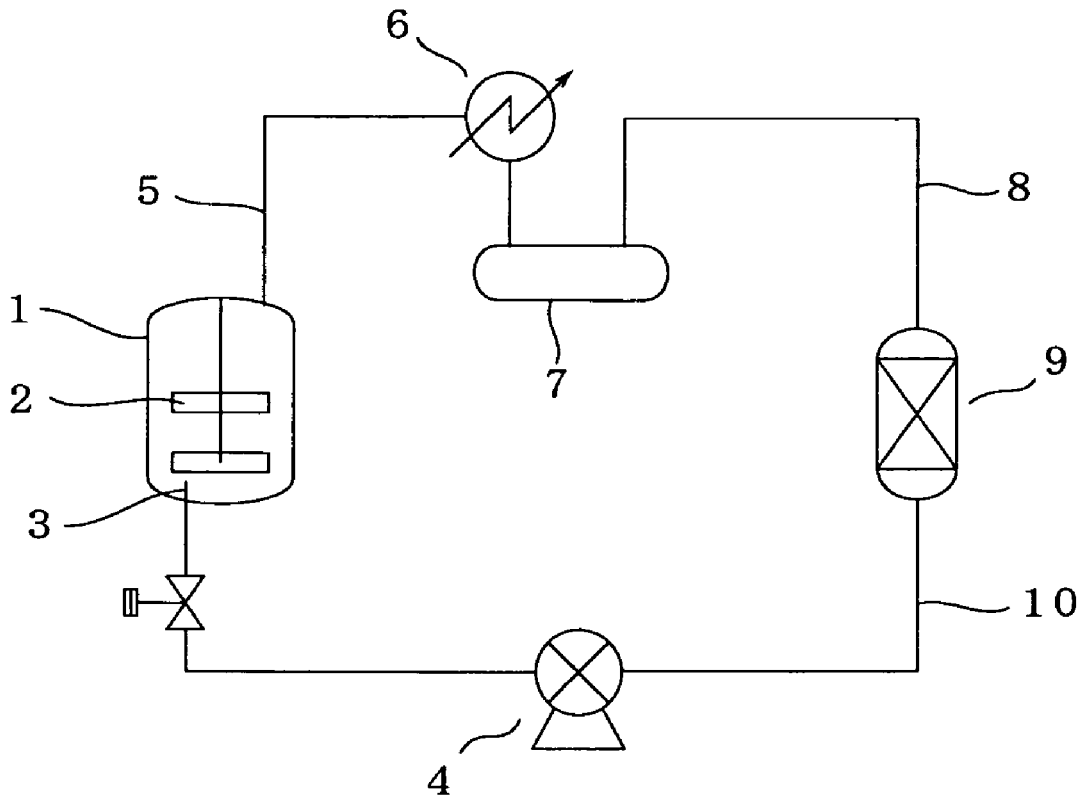
FIG. 1 is a schematic illustration of an example of the stripping treatment system adopted in a step of stripping treatment in the process according to the present invention.

Vaporizer 1 is arranged with a stirrer equipped with stirring blades 2. On the external wall of vaporizer 1 is equipped with a jacket (not shown in the FIGURE) for circulation of a heating medium. A gas such as nitrogen is blown into the vaporizer 1 from a gas source (not shown in the FIGURE) via gas inlet tube 3 by blower 4.

A part of the aqueous medium of aqueous dispersion, residual polymerizable monomer and other volatile substances are guided through gas line 5 to condenser 6, and then to condensing tank 7. Liquid components condensed and liquefied in the condensing tank 7 are recovered from the tank.

Gaseous components are guided through gas line 8 to volatile substance remover 9. The volatile substance remover 9 removes the polymerizable monomer and the other volatile organic compounds. Thereafter, gaseous components such as nitrogen gas is circulated through gas circulating line 10 and the blower 4, and reused.

DETAILED DESCRIPTION OF THE INVENTION

1. Step I of Preparation of Aqueous Dispersion of Colored Polymer Particles

The process for producing a polymerized toner according to the present invention includes a step I for obtaining an aqueous-dispersion comprising a colored polymer particles by polymerization step optionally followed by agglomeration step. In the step I, polymerization process such as suspension polymerization, dispersion polymerization and emulsion polymerization methods are adopted. Among them, the suspension polymerization and the emulsion polymerization methods are preferably used and the suspension polymerization is more preferable.

The suspension polymerization includes polymerization of a polymerizable monomer composition comprising at least a colorant and a polymerizable monomer in an aqueous medium. As the aqueous medium, an aqueous medium comprises a dispersion stabilizer is generally used. In the suspension polymerization process, a polymerizable monomer composition is dispersed first in an aqueous medium comprising a dispersion stabilizer to form fine droplets, and then suspension polymerization is subjected to form colored polymer particles. Thereafter, the colored polymer particles may further be polymerized with a polymerizable monomer for shell to give colored polymer particles having core-shell structure.

Therefore, the process according to the present invention comprises the step I of forming an aqueous dispersion comprising the colored polymer particles or colored polymer particles having core-shell structure by polymerizing a polymerizable monomer composition comprising at least a colorant and a polymerizable monomer in an aqueous medium to form a colored polymer particles, and then polymerizing a polymerizable monomer for shell in the presence of the colored polymer particles as needed.

The emulsion polymerization process includes emulsion polymerization of a polymerizable monomer composition comprising the polymerizable monomer and a colorant in an aqueous medium comprising an emulsifier, and then agglomeration of the resultant dispersed colored resin fine particles up to toner particle size.

Preferred emulsion polymerization process is carried out by emulsion polymerization of a polymerizable monomer in an aqueous medium comprising an emulsifier to give resin particles followed by and chemical agglomeration of the dispersed colorant with the emulsifier to give colored polymer particles having toner particle size. The resultant colored polymer particles are heated to give spherical colored polymer particles. Other toner additives such as a parting agent may be added in agglomeration process after dispersion with an emulsifier.

The aqueous medium generally includes water such as ion exchanged water and a hydrophilic solvent such as an alcohol may be added, if desired. The polymerization process is generally added with a dispersion stabilizer in aqueous medium to enhance stability of droplets of the polymerizable monomer composition dispersed in the aqueous medium.

The polymerizable monomer composition may contain various additives such as a charge control agent, a parting agent, a crosslinkable monomer, a macromonomer, a molecular weight modifier, a lubricant and a dispersion aid. The polymerizable monomer composition is polymerized in the presence of a polymerization initiator.

The suspension polymerization uses a dispersion stabilizer such as a colloid of hardly water-soluble metal hydroxide, and a surfactant may also be used together. The emulsion polymerization process is carried out by addition of various emulsifiers in the aqueous medium to disperse and stabilize the polymerizable monomer or its composition. The suspension polymerization process is preferable among above mentioned polymerization processes as the process can easily provides spherical colored polymer particles with desired particle size and core-shell structure. Thus, the present invention will be explained mainly by the suspension polymerization process.

(1) Polymerizable Monomer

A monovinyl monomer is used as a main component in the polymerizable monomer in the present invention. The monovinyl monomers includes, for example, aromatic vinyl monomers such as styrene, vinyltoluenes and α-methylstyrene; (meth)acrylic acid; (meth)acrylic acid derivatives such as methyl (meth)acrylate, ethyl (meth)acrylate, propyl (meth) acrylate, butyl (meth)acrylate, 2-ethylhexyl (meth)acrylate, cyclohexyl (meth)acrylate, isobornyl (meth)acrylate, dimethylaminoethyl (meth)acrylate and (meth)acrylamide; and monoolefin monomers such as ethylene, propylene and butylenes.

The monovinyl monomers may be preferably used singly or in combination with plural monomers.

Combinations of the monovinyl monomers with a crosslinkable monomer improve offset characteristic feature. The crosslinkable monomers may be used singly or in combination of two or more monomers and generally 10 parts by weight or less, preferably 0.01-7 parts by weight, more preferably 0.05-5 parts by weight, and specifically preferably 0.1-3 parts by weight per 100 parts by weight of the monovinyl monomers.

A combination of the monovinyl monomers with a macromonomer provides favorable balance between shelf stability at elevated temperature and fixability at low temperature. The macromonomers are macromolecules having polymerizable carbon-carbon unsaturated double bonds at the terminals of molecular chain and generally oligomers or polymers having number average molecular weight of 1,000-30,000. The macromonomers within the above mentioned number average molecular weight range maintain fixability and shelf stability of polymerized toners without affecting fusibility of macromonomer.

The polymerizable carbon-carbon unsaturated double bond at the terminal of molecular chain of macromonomers include such as acryloyl and methacryloyl group and the latter is preferable for the ease of copolymerization. The macromonomers providing polymers exhibiting higher glass transition temperature than that of polymers obtained by polymerization of monovinyl polymers are preferable.

Examples of macromonomers prepared by single or two or more mixed polymerization such as styrene, styrene derivatives, methacrylic acid esters, acrylic acid esters, acrylonitrile, methacrylonitrile; and macromonomers having polysiloxane skeleton can be enumerated. Among them, hydrophilic macromonomers are preferable and polymers obtained by single or combination polymerization of methacrylic acid esters and acrylic acid esters are preferable.

The macromonomers are generally used at 0.01-10 parts by weight, preferably 0.03-5 parts by weight, more preferably 0.05-1 part by weight per 100 parts by weight of monovinyl monomer. The amount of macromonomers used within the above mentioned range maintains the shelf stability and improves fixability of polymerized toner and are preferable.

(2) Colorants

Colorants such as various pigments and dyes used in the field of toner including carbon black and titanium white can be used.

Black colorants such as a carbon black, nigrosine based dyes and pigments; and magnetic particles such as cobalt, nickel, triiron tetraoxide, iron manganese oxide, iron zinc oxide and iron nickel oxide; can be enumerated. A carbon black with primary particle diameter of 20-40 nm gives favorable image quality with improved safety to environmental conditions.

Colorants for preparation of color toners include yellow, magenta and cyan colorants.

Yellow colorants such as condensed azo compounds, isoindolinone compounds, anthraquinone compounds, azo metallic complexes, methine compounds and allyl amide compounds are used. Practical examples include C.I. pigment yellow 3, 12, 13, 14, 15, 17, 62, 65, 73, 74, 83, 90, 93, 95, 96, 97, 109, 110, 111, 120, 128, 129, 138, 147, 155, 168, 180, and 181. Other pigments such as naphtol yellow S, Hansa Yellow G and C.I. Vat Yellow are enumerated.

Magenta colorants such as condensed azo compounds, diketopyrrolopyrole compounds, anthraquinone compounds, quinaclidone compounds, basic dye lake compounds, naphthol compounds, benzimidazolone compounds, thioindigo compounds and perylene compounds are enumerated. Practically, for example, C.I. pigment red 2, 3, 5, 6, 7, 23, 48, 48:2, 48:3, 48:4, 57, 57:1, 58, 60, 63, 64, 68, 81, 81:1, 83, 87, 88, 89, 90, 112, 114, 122, 123, 144, 146, 149, 163, 166, 169, 170, 177, 184, 185, 187, 202, 206, 207, 209, 220, 251 and 254 are enumerated. Others such as C.I. pigment violet 19 may be illustrated.

Cyan colorants such as copper phthalocyanine compounds and their derivatives, anthraquinone compounds and basic dye lake compounds can be illustrated. Practical examples include C.I. pigment blue 1, 2, 3, 6, 7, 15, 15:1, 15:2, 15:3, 15:4, 16, 17, 60, 62 and 66. Others such as phthalocyanine blue, C.I. Vat blue and C.I. Acid blue can be enumerated.

These colorants can be used singly or in two or more combinations. The colorants are used at 0.1-50 parts by weight and preferably 1-20 parts by weight per 100 parts by weight of the polymerizable monomers.

(3) Charge Control Agents

Addition of various positive or negative charge control agents to the polymerizable monomer composition is preferable to improve charging property of the polymerized toner.

Charge control agents, for example, metal complexes of carboxyl group or nitrogen comprising organic compounds, metal comprising dyes, nigrosine, charge control resins may be enumerated.

Practical examples of charge control agents include charge control agents such as BONTRON® N-01 (Orient Chemical Ind., Ltd.), Nigrosine base EX (Orient Chemical Ind., Ltd.), SPILON® black TRH (Hodogaya Chemical Co., Ltd.), T-77 (Hodogaya Chemical Co., Ltd.), BONTRON® S-34 (Orient Chemical Ind., Ltd.), BONTRON® E-81 (Orient Chemical Ind., Ltd.), BONTRON® E-84 (Orient Chemical Ind., Ltd.), Bontron® E-89 (Orient Chemical Ind., Ltd.), BONTRON® F-21 (Orient Chemical Ind., Ltd.), COPY CHARGE NX VP434 (Clariant AG), COPY CHARGE NEG VP2036 (Clariant AG), TNS-4-1 (Hodogaya Chemical Co., Ltd.), TNS-4-2 (Hodogaya Chemical Co., Ltd.), LR-147 (Japan Carlit Co., Ltd.) and Copy blue PR (Clariant AG); and charge control resins such as copolymers comprising a quaternary ammonium (salt) and copolymers comprising sulfonic acid (salt).

The charge control agents are used generally at 0.01-10 parts by weight and preferably 0.1-10 parts by weight per 100 parts by weight of the polymerizable monomer.

(4) Parting Agents

A parting agent may be contained in the polymerizable monomer composition for prevention of offset or to improve parting ability for fixing with heat roller.

The parting agents include, for example, polyolefin waxes such as low molecular weight polyethylene, low molecular weight polypropylene and low molecular weight polybutylene; vegetable natural waxes such as candelilla, carnauba, rice, Japan wax and jojoba; petroleum waxes such as paraffin, microcrystalline and petrolatum and their modified waxes; synthetic waxes such as Fischer-Tropsch wax; polyfunctional ester compounds such as pentaerythritol tetramyristate, pentaerythritol tetrapalmitate and dipentaerythritol hexamyristate. These parting agents may be used singly or in two or more combinations.

Among these parting agents, synthetic waxes, terminal modified polyolefin waxes, petroleum waxes and polyfunctional ester compounds are preferably used.

The parting agents are used generally at 0.1-50 parts by weight, preferably 0.5-20 parts by weight and more preferably 1-10 parts by weight per 100 parts by weight of the polymerizable monomer.

(5) Lubricants and Dispersion Aids

Fatty acids such as oleic acid and stearic acid, and their metal salts such as Na, K, Ca, Mg and Zn salts are used as lubricants and dispersion aids such as silane or titanium coupling agents may be contained in the polymerizable monomer to give homogenous dispersion of the colorant. These lubricants and dispersion agents are generally used at 1/1,000 to 1/1 ratios to the weight of colorants.

(6) Polymerization Initiators

Persulfates such as potassium or ammonium persulfate; azo compounds such as 4,4'-azobis(4-cyanovaleric acid), 2,2'-azobis[2-methyl-N-(2-hydroxyethyl)propionamide], 2,2'-azobis(2-amidinopropane) dihydrochloride, 2,2'-azobis (2,4-dimethylvaleronitrile), 2,2'-azobisisobutylonitrile; peroxides such as di-tert-butyl peroxide, dicumyl peroxide, lauroyl peroxide, benzoyl peroxide, tert-butyl peroxy-2-ethyl hexanoate, tert-hexyl peroxy-2-ethyl hexanoate, tert-butyl peroxy pivalate, di-isopropyl peroxy dicarbonate, di-tert-butyl peroxy isophthalate, 1,1',3,3'-tetramethylbutyl peroxy-2-ethyl hexanoate and tert-butylperoxy isobutylate may be enumerated as polymerization initiators of the polymerizable monomer. Redox initiators in combinations with these polymerization initiators may also be used as polymerization initiators.

Among these initiators, oil-soluble initiators which are soluble in the polymerizable monomer are preferably selected. Furthermore, a water-soluble polymerization initiator may be simultaneously used.

The polymerization initiators are generally used at 0.1-20 parts by weight, preferably at 0.3-15 parts by weight and more preferably 0.5-10 parts by weight per 100 parts by weight of the polymerizable monomer.

The polymerization initiators may be added to the polymerizable monomer in advance, however, they can be added during or after the droplet formation process of the polymerizable monomer composition or can be directly added to a suspension during the polymerization reaction.

(7) Molecular Weight Modifier

Addition of a molecular weight modifier is preferable for polymerization. The molecular weight modifier such as mercaptans of tert-dodecylmercaptan, n-dodecylmercaptan, n-octylmercaptan and 2,2,4,6,6-penta-methylheptane-4-thiol; halogenized hydrocarbons of carbon tetrachloride or carbon tetrabromide can be enumerated. These molecular weight modifiers are generally contained in the polymerizable monomer composition before the start of polymerization, however, they may be added during the polymerization reaction.

The molecular weight modifiers are generally used at 0.01-10 parts by weight and preferably at 0.1-5 parts by weight per 100 parts by weight of the polymerizable monomer.

(8) Dispersion Stabilizer

Colloid of hardly water-soluble metallic compounds is suitable for the dispersion stabilizer of the present invention. The hardly water-soluble metallic compounds such as sulfates including barium sulfate and calcium sulfate; carbonates including barium carbonate, calcium carbonate and magnesium carbonate; phosphates including calcium phosphate, metal oxides including aluminum oxide and titanium oxide, metal hydroxides including aluminum hydroxide, magnesium hydroxide and ferric hydroxide may be enumerated. Among them, colloid of the hardly water-soluble metal hydroxide narrows the particle diameter distribution of the polymer particles and suitable for improvement of clear images.

The colloid of hardly water-soluble metal compound may be prepared by conventional methods without restriction, however, adjustment of an aqueous solution of a water-soluble polyvalent metal compound at pH 7 or higher gives colloid of hardly water-soluble metal hydroxide and is preferable. Particularly, colloid of hardly water-soluble metal hydroxide formed by an aqueous phase reaction of a water-soluble polyvalent metal compound and an alkali metal hydroxide is preferable. The colloid of hardly water-soluble metal compound having number particle diameter distribution D50 (50% cumulative value of number particle diameter distribution) of at most 0.5 μm and number particle diameter distribution D90 (90% cumulative value of number particle diameter distribution) of at most 1 μm is preferable.

The dispersion stabilizer is generally used at 0.1-20 parts by weight per 100 parts by weight of the polymerizable monomer. Excessively small ratios of the dispersion stabilizer to the polymerizable monomer makes polymerized stability insufficient and liable to form polymerized agglomeration. Conversely, excessively large ratio of the dispersion stabilizer to the polymerizable monomer makes the aqueous solution highly viscous and lowers the polymerization stability.

In the present invention, a water-soluble polymer may be used as a dispersion stabilizer, if necessary. The water-soluble polymers such as polyvinyl alcohol, methylcellulose and gelatin are enumerated. No surfactant is necessary in the present invention, however, it may be used to stabilize suspension polymerization within a range not to increase environmental dependency of electric charge property.

(9) Polymerization Process

The polymerization toner is composed of a colored polymer particles of polymerized binder resin formed by polymerization of the polymerizable monomer including dispersed components such as a colorant and a parting agent. A polymer particles having core-shell structure may be formed by using the colored polymer particles as a core, forming a shell formed from a polymer layer on the core.

In case of suspension polymerization, the polymerized toner can be prepared, for example, by the following processes.

The polymerizable monomer, a colorant and other additives are mixed together using a mixer and, if necessary, wet ground using a media type wet pulverizer (e.g. beads mill) to prepare the polymerizable monomer composition.

Then, the polymerizable monomer composition is dispersed and stirred in an aqueous medium comprising a dispersion stabilizer to give primary homogenous droplets of the polymerizable monomer composition generally having volume average particle diameter of 50-1,000 μm. Thereafter, polymerization initiator is preferably added to avoid early polymerization.

A polymerization initiator is added to the suspension in which the droplets of the polymerizable monomer composition are dispersed, to mix them. The resultant mixture is further formed into droplets by means of a high-speed shearing stirrer in such a manner that the droplet diameter thereof becomes a small diameter close to that of the intended toner particles. Thus, the suspension comprising secondary fine size droplets generally having volume average particle diameter of 1-12 μm is prepared.

The resultant suspension comprising fine particle droplets is placed in a polymerization reaction vessel and caused to suspension polymerization generally at 5-120° C., preferably at 35-95° C. Excessively low polymerization temperature demands a highly catalytically active polymerization initiator and the management of polymerization becomes difficult. While excessively high polymerization temperature causes bleed of the low melting point additives on the surface of polymerized toner and may lower the shelf stability of polymerized toner.

The volume average particle diameter and distribution of particle diameter of fine droplets of the polymerizable monomer composition influence on the resultant volume average particle diameter and distribution of particle diameter of polymerized toner. Excessively large particle diameter of droplets makes the formed polymerized toner particles (colored polymer particles) too large and decreases resolution of images. Wider particle diameter distribution causes scattered fixing temperature leading to cause troubles such as fog or toner filming. Thus, similar sizes of droplets of the polymerizable monomer composition to those of formed polymerized toner particles are preferable.

The volume average particle diameter of droplets of the polymerizable monomer composition is generally 1-12 μm, preferably 2-10 μm and more preferably 3-8 μm. The volume average particle diameter of droplets is preferably 2-9 μm, more preferably 3-8 μm and further more preferably 3-7 μm under high resolution to give highly fine images using fine particles of polymerized toner.

The particle diameter distribution of droplets of the polymerizable monomer composition (volume average particle diameter/number average particle diameter) is generally 1-3, preferably 1-2.5 and more preferably 1-2.

Particularly, formation of extra fine droplets can be preferably accomplished by passing an aqueous dispersion medium comprising the monomer composition through a gap between a rotor under high speed rotation and a surrounding stator around the rotor having small pores or comb.

One or more monovinyl monomers are selected as polymerizable monomer. The polymerizable monomer may be preferably used singly or combinations to give polymers with glass transition temperature, Tg, generally at 80° C. or lower, preferably 40-80° C. and more preferably 50-70° C. to lower the fixing temperature of the toner.

In the present invention, Tg of the polymerized monomer constructing the binder resin is calculated from the kind of used polymerizable monomer and its used ratio, that is "calculated Tg".

The suspension polymerization provides colored polymer particles with dispersed additive components such as a colorant in the polymerized particles of the polymerizable monomer. In the present invention, the resultant colored polymer particles are used as a polymerizing toner. A polymerized layer may further be formed on the colored polymer particles obtained by the suspension polymerization to give colored polymer particles having core-shell structure and to improve the shelf stability of the polymerized particles, (that is "blocking resistance"), fixing at low temperature and fusibility in fixing.

Formation of the core-shell structure can be accomplished, for example, by further polymerization of the polymerizable monomer for shell in the presence of core particles using the colored polymer particles as core particles to give thin polymerized layer (shell) on the surface of the core particles.

When a polymerizable monomer capable of forming a polymer having Tg higher than Tg of the polymer component forming core particles is used as the polymerizable monomer for shell, the shelf stability of the resulting polymerized toner can be enhanced. On the other hand, When Tg of the polymer component forming core particles is set lower, the fixing temperature of polymerized toner may be lowered and characteristic feature in fusing is improved. Thus, formation of colored polymer particles having core-shell structure in the polymerization process gives the polymerized toner capable to accommodate with high speed printing, full color printing and transparency of sheets used in overhead projector (OHP).

The polymerizable monomer for forming core and shell can be suitably selected from aforementioned monovinyl monomers. The weight ratios of the polymerizable monomers for cores and those for shells are generally 40/60 to 99.9/0.1, preferably 60/40 to 99.7/0.3, more preferably 80/20 to 99.5/0.5. Excessively small ratios of the polymerizable monomers for shells give poor effect on improvement of shelf stability of the polymerized toner and excessively large ratios give small lowering effect in fixing temperature.

Tg of a polymer formed from the polymerizable monomer for shell is generally higher than 50° C. to not higher than 120° C., preferably higher than 60° C. to not higher than 110° C., more preferably higher than 80° C. to not higher than 105° C. The difference of Tg values between a polymer formed from the polymerizable monomer for core and those for shells is preferably 10° C. or over, more preferably 20° C. or over and particularly preferably 30° C. or over. In most cases, the polymerizable monomer for core is preferably selected from those having Tg at 60° C. or less and preferably at 40-60° C. in view of balance between fixing temperature and shelf stability.

While the polymerizable monomer for shell is preferably selected singly or in two or more combinations from those forming polymer having Tg at 80° C. or over such as styrene and methyl methacrylate.

The polymerizable monomer for shell is preferably added to a polymerization reaction system as smaller size droplets than the average size of core particles. Excessively large particle diameter of droplets of the polymerizable monomers for shells is liable to cause uneven polymer layer around the core particles. Micro-dispersion of a mixture of the polymerizable monomers for shells and an aqueous dispersion medium by, for example, an ultrasonic emulsifier and addition of the resultant dispersion to the polymerization reaction system gives fine droplets of the polymerizable monomers for shells.

No micro-dispersion treatment in an aqueous dispersion medium is necessary for the comparatively water-soluble polymerizable monomers for shells having water solubility of 0.1% by weight or over at 20° C. (for example methyl methacrylate) because of their comparatively smooth transition on the core surface, however, micro-dispersion treatment for the formation of homogenous shell is preferable.

Micro-dispersion of the polymerizable monomers for shells having water solubility of less than 0.1% by weight at 20° C. (for example styrene) is preferably carried out in an aqueous dispersion medium or dispersion by addition of an organic solvent having water solubility of 5% by weight or over at 20° C. (for example alcohols) to make smooth transition of the monomers on the core surface.

A charge control agent may be added to the polymerizable monomers for shells. The charge control agent similar to that used in preparation of above mentioned core particles is preferably used. The charge control agent is generally used at 0.01-10 parts by weight and preferably 0.1-5 parts by weight per 100 parts by weight of the polymerizable monomers for shells.

Preparation of polymerized toner having core-shell structure is carried out by addition of the polymerizable monomer for shells to a suspension comprising core particles at one time, continuously or dividedly.

Addition of the polymerizable monomer for shells together with a water-soluble residual initiator is preferable for effective formation of shells. Simultaneous addition of the polymerizable monomer for shells and the water-soluble polymerization initiator is presumed to accelerate the infiltration of the water-soluble polymerization initiator around outer surface of core particles with transfer of the polymerizable monomer for shells. This will help formation of polymerized layer on the surface of core particles.

The water-soluble polymerization initiators such as persulfate including potassium or ammonium persulfate and azo initiators including 2,2'-azobis[2-methyl-N-(2-hydroxyethyl)propionamide, 2,2'-azobis[2-methyl-N-[1,1-bis(hydroxymethyl)ethyl]-propionamide] may be enumerated. The required amount of the water-soluble polymerization initiators is generally 0.1-50% by weight and preferably 1-20% by weight per 100% by weight of the polymerizable monomer for shells.

The average thickness of shell is generally 0.001-1.0 μm, preferably 0.003-0.5 μm and more preferably 0.005-0.2 μm. Excessively thick shell lowers fixability of the polymerized toner and excessively thin shell lowers shelf stability of the polymerized toner.

The core particle diameter and the shell thickness of polymerized toner can be directly determined by observation of diameter of randomly selected particles and shell thickness with an electron microscopic observation, or calculated on the particle diameter and the used amount of polymerizable monomer when the electron microscopic observation is unavailable.

2. Stripping Treatment Step II

An aqueous dispersion comprising colored polymer particles (including those with core-shell structure) is prepared by the aforementioned step I. Then the aqueous dispersion is subjected to stripping treated to remove volatile organic compounds contained in the colored polymer particles. The volatile organic compounds include such as low boiling point organic compounds contained in raw materials or in by-product in addition to unaltered polymerizable monomer.

In the present invention, an aqueous dispersion comprising the colored polymer particles is subjected to stripping treatment in the presence of a nonionic surfactant having a cloud point. Single or combined use of nonionic surfactants having a cloud point as a dispersion stabilizer or an emulsifier in the polymerization process optionally followed by agglomeration process gives the aqueous dispersion comprising the nonionic surfactant.

In suspension polymerization, a nonionic surfactant having a cloud point is generally added as a de-foaming agent in suspension polymerization to the aqueous dispersion comprising colored polymer particles obtained by the polymerization process to carry out stripping treatment. The whole amount of nonionic surfactant may be added as a de-foaming agent in advance, intermittently or continuously to an aqueous dispersion comprising the colored polymer particles in stripping treatment process.

Conventional nonionic surfactants having cloud point widely used in the technical field of de-foaming agents are suitably used. Among them, polyether nonionic surfactants are preferably used, and polyalkylene glycol nonionic surfactant (or may be called "polyoxyalkylene glycol nonionic surfactant") are particularly preferably used.

Polyalkylene glycol nonionic surfactants include such as polyethylene glycol nonionic surfactant, polypropylene glycol nonionic surfactant and their mixed nonionic surfactant. Polyethylene glycol nonionic surfactants are preferable as nonionic surfactants having cloud point. Other nonionic surfactants having cloud point such as polypropylene glycol nonionic surfactant, polyethylene glycol/polypropylene glycol nonionic surfactant may be used. In addition, non-silicone de-foaming agents such as emulsions comprising fat and polyalkylene glycol nonionic surfactants, and a mineral oil and polyalkylene glycol nonionic surfactants having cloud point can be suitably used.

Some polyalkylene glycol nonionic surfactant such as polyethylene glycol shows cloud point. Dissolution of polyethylene glycol chain (hydrophilic group) of nonionic surfactants in water is formation of a weak bond (hydrogen bond) due to hydration of water molecule with ether oxygen atom (—O—). Temperature elevation of the aqueous solution decreases hydration rate and the balance between hydrophilic and hydrophobic groups tends to become hydrophobic, or makes micelle dissolution difficult at a predetermined temperature and separates the nonionic surfactant, and this temperature is called cloud point.

The cloud point of nonionic surfactants used in the present invention are preferably at 5-80° C., more preferably at 8-50° C. and particularly preferably at 10-40° C. Application of nonionic surfactants having high cloud point allows temperature elevation of washing water. On the other hand, nonionic surfactants having low cloud point exhibit excellent de-foaming action and capable of effective decrease of the amount of residual polymerizable monomer together with suppression of foaming.

The HLB values of nonionic surfactant used in the present invention is preferably at 1-13, more preferably at 1-12 and particularly preferably at 1-8. The HLB value represents the balance between hydrophilicity and hydrophobicity as well known for persons skilled in the art of surfactants and can be calculated according to theory of Davies.

Nonionic surfactants having cloud point can be selected from various commercial de-foaming agents or anti-foaming agents. Nonionic surfactants having cloud point are generally selected from polyalkyleneglycol nonionic surfactants, for example, polyethylene glycol nonionic surfactants and polyoxyethylene.polyoxypropylene block copolymer type nonionic surfactants. Commercial products include, for example, "SN-DEFOAMER® series" (polyalkylene glycol nonionic surfactants) of "SN-DEFOAMER® 180", "SN-DEFOAMER® 265" and "SN-DEFOAMER® 444" (San Nopco Ltd.).

Concentration of a solid component in an aqueous dispersion comprising the colored polymer particles supplied to stripping treatment is preferably in a range of 5-45% by weight, more preferably at 10-40% by weight and particularly preferably at 15-35% by weight. If comparatively high concentration of the aqueous dispersion is obtained in its preparation process I, water such as ion exchanged water may be added in stripping treatment to adjust dispersion to desired concentration of solid component.

The nonionic surfactants having cloud point is generally added as a de-foaming agent in stripping treatment process preferably at 0.01-1 part by weight, and more preferably at 0.05-0.5 part by weight per 100 parts by weight of the polymerizable monomer composition or the colored polymer particles. Excessively small ratios of the nonionic surfactant make insufficient de-foaming effect and excessively large ratios of the nonionic surfactant saturates the de-foaming effect and may affects characteristic features of the toner.

Stripping treatment of the aqueous dispersion carried out by bubbling method with blowing in an inert gas (for example, nitrogen, argon and helium), water vapor, dried air and carbon dioxide, reduced pressure stripping method with heating under reduced pressure, and flushing method are enumerated. Among them, bubbling method and reduced pressure stripping method are preferable. The reduced pressure stripping method may be carried out by blowing in a gas in the aqueous dispersion. The gas to be blown in may be heated up to moderate temperature lower than 100° C. for prevention of agglomeration of colored polymer particles. Inert gas such as nitrogen gas is preferable.

In stripping treatment, heating of the aqueous dispersion can increase de-foaming effect, accelerates vaporization of volatile organic compounds such as residual polymerizable monomer and improves recovery rate. The temperature of the aqueous dispersion in the stripping treatment is preferably at not lower than a glass transition temperature, Tg, of the polymer component constructing the polymer particles to lower than 100° C., more preferably at not lower than Tg to not higher than 95° C. and furthermore preferably not lower than Tg+5° C. to not higher than 90° C. Tg is a determined value using a differential scanning calorimeter (DSC). The lowest Tg temperature is made as a standard Tg value for two or more determined Tg values of polymerized components. The aqueous dispersion temperature for stripping treatment is preferably controlled at almost constant desirable temperature within the above mentioned range.

Heating of the aqueous dispersion is preferably carried out, for example, using a vaporizer (vaporizing tank) equipped with a heating medium circulating jacket, a vaporizer with an internally furnished heat exchanger or a vaporizer connected to an externally furnished heat exchanger. Heated gas may be blown in the aqueous dispersion to elevate the temperature of solution. Excessively low temperature of the aqueous dispersion causes insufficient vaporization of the aqueous medium in dispersion in stripping treatment, slows the transfer of residual polymerizable monomer in the colored polymer particles and lowers the removal rate of residual polymerized monomer from the colored polymer particles. Excessively high temperature of the aqueous dispersion affects dispersion stability of the colored polymer particles and is liable to cause agglomeration during treatment or increased adhesion of scales on the wall of the vaporizer and stirrer.

The inner pressure of vaporizer may be suitably decided by practical stripping methods and generally selected within a range of 5-105 kPa. Gas blowing method for the stripping treatment may generally select inner pressure of the vaporizer in a range of 70-105 kPa. Stripping under reduced pressure optionally with blowing in a gas is generally controlled inner pressure of the vaporizer in a range of 5-70 kPa, preferably 10-60 kPa and more preferably 20-50kPa.

Period of stripping treatment varies with the size of treatment apparatus, amount of treatment, practical method of treatment and desired level of residual polymerizable monomer amount, and suitably selected generally for 0.5-50 hours, preferably for 1-30 hours and more preferably for 3-20 hours.

Preferably, a stirrer is arranged in the vaporizer to carry out stripping treatment under stirring. Any stirrer may be used and stirrers equipped with wide paddle blades, wide slanted blades, Brumargin blades and its modified blades, full zone blades or wall wetter blades are preferably used. A part of the blade may be projected above the surface of liquid as shown in Japanese Patent Laid open No. 2001-117272.

The stripping treatment removes a part of aqueous medium in the aqueous dispersion, residual monomer contained in the aqueous dispersion and polymer particles, and the other volatile substances. Thus, dispersion in the vaporizer is concentrated by the stripping treatment and an aqueous dispersion medium may newly be added, if desired, to supply the vaporized aqueous dispersion medium. However, according to the process of the present invention the stripping treatment can be effectively carried out without addition of aqueous dispersion medium and the recovered residual polymerizable monomer and aqueous dispersion medium may be reused.

FIG. 1 shows an example of stripping treatment system applicable to the present invention. Vaporizer 1 is equipped with a stirrer having stirring blades 2. The outer wall of the vaporizer 1 is equipped with a heating medium circulating jacket (not shown in the FIGURE), so that the inner temperature of the vaporizer is controlled at desired temperature. A gas such as nitrogen is introduced in the vaporizer 1 through a gas inlet line 3 from the gas source (not shown in the FIGURE) by a blower 4.

The inner temperature of the vaporizer 1 is elevated up to a predetermined temperature with stirring, then, a gas is blown in the vaporizer 1 through an opening of blowing pipe 3 by a blower 4. A part of the aqueous medium of the aqueous dispersion, residual polymerizable monomer and other volatile substances are guided through a gas line 5 to a condenser 6, and then to a condenser tank 7. The condensed and liquefied components such as water in the condenser tank 7 is recovered (no recovery line is shown).

The gaseous components are guided through a gas line 8 to a volatile substance removing apparatus 9. The volatile substance removing apparatus 9 is, for example, an absorption tower filled with active charcoal and a bubbling apparatus filled with cold water. The volatile substance removing apparatus 9 removes polymerizable monomer and other volatile organic compounds. Then, gaseous components such as nitrogen gas is guided through a gas circulation line 10 and then the blower 4 and may be reused.

The flow rate of gas such as nitrogen gas is preferably controlled within the range of 0.05-2 $m^3/(hr \cdot kg)$ and more preferably 0.1-1 $m^3/(hr \cdot kg)$ in view of suppression of foaming. Simple stripping treatment under reduced pressure without blowing in a gas vaporizes heated aqueous dispersion by intensifying the pressure reduction rate in the system without using the blower 4.

According to the process of the present invention, since foaming on the surface of the aqueous dispersion can be effectively inhibited, stable stripping treatment can be performed. According to the process of the present invention, dried colored polymer particles (polymerized toner) can be provided with residual polymerizable monomer generally at less than 100 ppm, preferably at less than 50 ppm, more preferably at less than 30 ppm and particularly preferably at less than 20 ppm. Low boiling point volatile organic compounds other than unaltered polymerizable monomer are removed by the stripping treatment. It is suitable to make the residual amount of polymerizable monomer affecting the odor and characteristic features of toner as a marker for the efficacy of stripping treatment in view of the characteristic features of toner.

According to the present invention, since stripping treatment is carried out in the presence of the nonionic surfactant having cloud point, polymerized toner with high charging property without showing adverse influence on the charging property of polymerized toner can be provided. The polymerized toner obtained by the process of the present invention gives deep uniform images with markedly inhibited fog.

3. Washing Step III

After the stripping treatment process II, the colored polymer particles is taken out from the aqueous dispersion. To take out the colored polymer particles, washing step is arranged to wash the colored polymer particles and purify it. The colored polymer particles is taken out by conventional methods of dehydration, washing, filtration and drying, and the dried colored polymer particles are taken out. Generally the used dispersion stabilizer is removed prior the dehydration by solubilization, for example, washing with an acid or an alkali by the kind of dispersion stabilizer.

For example, when the colloid of hardly water-soluble metal hydroxide such as magnesium hydroxide colloid is used as the dispersion stabilizer, an acid such as sulfuric acid is added to the aqueous dispersion to solubilize the dispersion stabilizer to water (this method is called "acid washing"). The pH of the aqueous dispersion is preferably adjusted to 5 or less by the acid washing.

After acid or alkali washing, the aqueous dispersion is filtered and dehydrated. After dehydration, the colored polymer particles are washed with water. Washing is preferably carried out by repetitive supply and dehydration of washing water, however continuous washing is preferable for effective washing. Therefore, washing with water using a washing and dehydration apparatus is preferable. For example, continuous belt filter or siphon peeler type centrifuge may be enumerated as preferred washing with water and dehydration apparatus.

A continuous type belt filter is equipped with an endless going around filter cloth and has a filtration operating part for the filter cloth running in horizontal direction. A vacuum tray is positioned under the filter cloth at the filtration part. As explained above, the belt filter is generally made of an endless filter cloth. The filter cloth is tightly hung on plural rolls. An integrated or pluralistically divided vacuum tray compartment is placed under the filter cloth in the filtration operating part.

The filter cloth is made of synthetic resin such as nylon, polyester and polypropylene. The filter cloth is preferably constructed with nonwoven fabric with moderate air permeability. The vacuum tray is generally made of a synthetic resin such as polypropylene. The aqueous dispersion comprising the colored polymer particles is supplied on the endless filter cloth (endless belt) of the continuous belt filter, filtered (dehydrated) and washed (with water).

A siphon peeler type centrifuge is a centrifugal filter equipped with a siphon mechanism having a combined functional structure of centrifugal filtration and vacuum filtration. The siphon peeler type centrifuge aspirates the filtrate with a siphon tube to generate reduced pressure under the filter cloth to characterize simultaneous centrifugal filtration pressure and vacuum filtration pressure.

Any washing machine capable of dehydration and washing with water may be suitably used in the present invention in addition to the above mentioned dehydration and washing machine.

In the present invention, washing is carried out using washing water, temperature of which is controlled to below the cloud point of nonionic surfactant added in the aqueous dispersion in the stripping treatment step. Water such as ion exchanged water is generally used as the washing water and a mixed solution of water and an organic solvent such as alcohol may be used to improve cleaning effect.

When the temperature of the washing water is not lower than the cloud point of the nonionic surfactant, the residual amount of nonionic surfactant in the colored polymer particles (polymerized toner) is increased and charging and imaging characteristic features tend to decline.

Heretofore, the temperature of washing water has been set comparatively high temperature in view of effective removal of the dispersion stabilizer and others. However, since nonionic surfactants having cloud point is extremely poor in solubility in water at temperature of not lower than the cloud point, the amount of the residual nonionic surfactant in the polymerized toner after washing becomes considerably large.

The inventors of the present invention found that increased amount of the residual nonionic surfactant in the polymerized toner causes insufficient charge for imaging, particularly under high temperature and humidity. Furthermore, increased amount of the residual nonionic surfactants in the polymerized toner causes markedly intensified fog under high temperature and humidity.

A countermeasure of washing with washing water at temperature below the cloud point of nonionic surfactant markedly lowered the residual amount of the nonionic surfactant. Thus, a polymerized toner maintaining high charging capacity even under high temperature and humidity accompanied with markedly inhibited fog can be obtained.

The difference between the cloud point of nonionic surfactant A (° C.) and temperature of washing water B (° C.), that is A−B, is preferably adjusted at not less than 3° C., more preferably at not less than 5° C., and particularly preferably at not less than 10° C. The lower the temperature of washing water, the higher the removal rate of nonionic surfactant can be obtained. However, the removal rate of the other impurities such as dispersion stabilizer declines, and the lower limit of the temperature of washing water is generally 0° C., preferably 5° C. and more preferably about 8° C.

The ratios of washing water such as washing water is preferably in a range of 200-1,500 parts by weight per 100 parts by weight of the colored polymer particles. Dehydration and washing using a continuous belt filter is preferably carried out by spraying ion exchange water, temperature of which is controlled at a rate of 20-50 kg/hour on a wet cake placed on a going around endless belt with dehydration from the backside of belt. The filtration zone at the last of circulating endless belt performs filtration solely under reduced pressure without spraying washing water.

After washing, dehydrated wet cake by filtration generally shows moisture content of 10-60% by weight, and in most cases, 20-50% by weight. The resultant wet cake is dried in the next step.

4. Step IV of Getting Colored Polymer Particles

After washing process III, wet colored polymer particles (wet cake) is gotten and dried. The drying can be performed with a dryer maintained at high temperature or a vacuum dryer.

The volume average particle diameter of the polymerized toner (including capsule toner having core-shell structure) of the present invention is generally 1-12 μm, preferably 2-11 μm and more preferably 3-10 μm. Preferable volume average particle diameter of the polymerized toner to obtain highly fine images with improved resolution rate is 2-9 μm and more preferably 3-8 μm.

The ratios of particle diameter distribution, Dv/Dp, expressed by the volume average particle diameter, Dv, and number average particle diameter, Dp, of the polymerized toner of the present invention is generally 1.7 or less, preferably 1.5 or less and more preferably 1.3 or less. Excessively large Dv of the polymerized toner is liable to cause decline of resolution. Large particle diameter distribution of the polymerized toner causes increased ratio of large diameter toner particles and is liable to decline the resolution.

The shape of polymerized toner of the present invention is preferably spherical with major axis, dl, and minor axis, ds, and expressed by a ratio, dl/ds. The preferred ratio is substantially spherical of 1-1.3 and preferably 1-1.2. Highly fine images with high resolution rate and improved transcription effect of the photosensitive toner image to transcription materials can be obtained using substantially spherical fine particles of polymerized toner as a non-magnetic one component developer.

The amount of residual polymerizable monomer of polymerized toner of the present invention is generally less than 100 ppm, preferably less than 50 ppm, more preferably less than 30 ppm and particularly preferably less than 20 ppm. An excessively large amount of the residual polymerizable monomer declines charging property and characteristic features of images of the polymerized toner.

The amount of residual nonionic surfactants in polymerized toner of the present invention is preferably less than 100 ppm, more preferably less than 50 ppm and particularly preferably less than 30 ppm. Excessively large amount of residual nonionic surfactants makes improvement of characteristic features of charging and imaging difficult and further increases their environment dependency to decrease the amount of charging under high temperature and humidity, and liable to cause fog.

The polymerized toner of the present invention can be used as a toner component in various developers and preferably used in non-magnetic one component developer. Application of the polymerized toner of the present invention to non-magnetic one component developer may be carried out by mixing with other external additives of inorganic particles or organic resin particles such as a fluidizer and an abrasive, if necessary.

The inorganic particles such as silicon dioxide (silica), aluminum oxide (alumina), titanium oxide, zinc oxide, tin oxide, barium titanate and strontium titanate are enumerated.

The organic resin particles such as methacrylic acid ester polymer particles, acrylic acid ester polymer particles, styrene-methacrylic acid ester copolymer particles and styrene-acrylic acid ester copolymer particles, and core-shell structured particles in which core is styrene polymer and shell is methacrylic acid ester copolymer, are enumerated.

Among them, inorganic oxide particles are preferable and silicon dioxide is particularly preferable. The surface of inorganic particles may be treated to make hydrophobic. Silicon dioxide particles made to hydrophobic is particularly preferable as an external additive. Two or more external additives may be used in combinations and combinations of different average particle diameter of inorganic particles or mixtures of inorganic particles and organic particles are preferable. The amount of external additives is not definitive and generally 0.1-6 parts by weight per 100 parts by weight of the polymerized toner is used. Adhesion of the external additive to the polymerized toner is generally carried out by mixing and stirring them in a HENSCHEL MIXER.

EXAMPLES

Examples and comparative examples are shown below to more practically explain the present invention. "part" and "%" used in these examples and comparative examples are based on weight except otherwise stated.

The determination and evaluation methods of various physical properties and characteristic features in the present invention are as follows.

1. Determination Method of the Residual Amount of Polymerizable Monomer (1) Before Stripping Treatment Three grams of the colored polymer particles was precisely weighed before stripping treatment up to one milligram unit. 27 g of N,N-dimethylformamide was added to three grams of the colored polymer particles and stirred for 15 minutes.

Then, 13 g of methanol was added thereto and stir for further 10 minutes. The resultant solution was allowed to stand still to precipitate insoluble matters. The supernatant of resultant solution was taken for a determination sample and two microliter of the sample was injected in a gas chromatograph to quantitatively determine the amount of polymerizable monomer.

The determination conditions for gas chromatograph were column=TC-WAX (0.25 mm×30 m), column temperature=80° C., injection temperature=200° C. and FID detection side temperature=200° C. N,N-dimethylformamide methanolic solution of each polymerizable monomer was used as standard samples for quantitative analysis.

The colored polymer particles before stripping treatment were wet and the residual amount of polymerizable monomer in the colored polymer particles was calculated as a ratio of pure solid components in the wet colored polymer particles. More specifically, multiply calculated ratio of pure solid components by the amount of polymerizable monomer in the colored polymer particles determined in wet state to calculate the amount of residual polymerizable monomer.

The amount of pure solid components in the wet colored polymer particles was estimated by the following steps (i) to (v).

(i) Take aqueous dispersion of the colored polymer particles before stripping treatment.

(ii) Filter the aliquot of aqueous dispersion to give the colored polymer particles in wet state.

(iii) Precisely weigh the colored polymer particles in wet state up to one milligram.

(iv) Dry up the wet colored polymer particles at 105° C. for an hour and precisely weigh the dried solid component.

(v) Calculate the concentration of pure solid component in the wet colored polymer particles from the weight difference between before and after drying.

(2) After Stripping Treatment

After stripping treatment, the three grams of washed and dried colored polymer particles was precisely weighed up to one milligram. The amount of polymerizable monomer was determined in a similar manner except for the use of these polymer particles. The residual amount of polymerizable monomer in the colored polymer particles after washing and drying was calculated as a ratio to the weight of the colored polymer particles. In each example and comparative example, the kind of residual polymerizable monomer after stripping treatment and drying was substantially only styrene.

2. Method for Determination of Residual Nonionic Surfactant

Ten grams of a dried toner was subjected to methanol extraction using Soxhlet method, and then the extract was concentrated and dried. The extract was mixed with 2 ml of an aqueous solution of distilled water and acetonitrile, the volume % of distilled water/acetonitrile=50/50 vol %, ultrasonically extracted, filtered through a membrane filter having pore size of 0.45 μm. The filtrate was determined with LC-MS. Determination was carried out by using ZORBAX SB-C18 (2.1 mm×150 mm) as a column for LC-MS and under the following conditions:

Column temperature: 40° C.,

Flow rate: 0.2 ml/min.,

Amount of injection: 10 μl, and

Standard sample for quantitative determination:

water/acetonitrile=50/50 vol % solution for each de-foaming agent.

3. Evaluation of Characteristic Features of the Toner (1) Particle Diameter

The particle diameter distribution of colored polymer particles (polymerized toner particles) shown by the ratio, expressed as Dv/Dp, of volume average particle diameter, Dv, and number average particle diameter, Dp, was determined with Multisizer (Beckman Coulter, Inc.). Determination with Multisizer was carried out by the following conditions. Aperture diameter=100 μm, medium=Isoton II, concentration=10% and determined number of particles=100,000.

(2) Charge Level

A sheet of copy paper was set in a commercially available printer (printing speed: 24 paper sheets per minute) of a non-magnetic one-component development system, and then a developer (toner) to be evaluated was placed in a developing device of the printer. The printer was allowed to stand for a day under a environment of 23° C. in temperature and 50% in humidity (N/N environment), printing was conducted, and the developer on a developing roll was then sucked at 10th sheet of the copy paper from the start of printing in a suction type charge level meter to measure a charge level per unit weight [Q/M (μC/g)] from the charge level and weight of the developer sucked at this time.

Similarly, the printer was allowed to stand for a day at 30° C. in temperature and 80% in humidity (H/H environment), printing was conducted, and the developer on the developing roll was then sucked at 10th sheet of copy paper from the start of printing in the suction type type charge level meter to measure a charge level per unit weight [Q/M (μC/g)] from the charge level and weight of the developer sucked at this time.

4. Evaluation of Images (1) Image Density

A commercial non-magnetic one component developing printer (printing speed=24 sheets/min.) was used and allowed to stand at 23° C. and 50% humidity (N/N environment) for a day and continuously printed at 5% density and solid printed at 100th sheet. The image density was determined for the top and tail of solid printing using McBeth transmitting image densitometer.

(2) Fog

The developer to be evaluated was placed in the developing device of a commercial non-magnetic one component developing printer (printing speed=24 sheets/min.) The developing printer was allowed to stand for a day at 23° C. and 50% humidity (N/N environment) and for a day at 30° C. and 80% humidity (H/H environment), respectively. Thereafter the printer was continuously set with 5% image density on a printing paper. Whole white solid printing was performed at 100th sheet and the printing was discontinued on the way. The toner on a photosensitive sheet after development was peeled off with an adhesive tape (SCOTCH® mending tape 810-3-18, Sumitomo 3M) and adhered on a new sheet of printing paper. Whiteness (b) of the adhered sheet of printing paper was determined with a color meter (Nippon Denshoku Ind., Co., Ltd.). Similarly, whiteness (a) of a sheet of printing paper solely adhered with the adhesive tape was determined. The difference (a−b) of whiteness (a) and (b) was calculated to give fog value.

Example 1

1. Step I (Preparation of Aqueous Dispersion of Colored Polymer Particles)

(i) Step I-1 (Preparation of Polymerizable Monomer Composition for Core)

A mixture of a polymerizable monomer composed of 80.5 parts of styrene and 19.5 parts of n-butyl acrylate (calculated Tg=55° C. for a copolymer obtained from those monomers), five parts of C.I. Pigment Blue 15:3 (FASTGEN BLUE® CT-BX121, Dainippon Ink and Chemicals Inc.), four parts of a charge control agent (Styrene/acrylic resin, FCA®-626N, Fujikura Kasei Co., Ltd.) and 0.25 part of polymethacrylic acid ester macromonomer (AA6, Toagosei Co., Ltd.) was homogenized with a high speed emulsifying.dispersing apparatus (T.K. HOMOMIXER® MARK II, Tokushu Kiko Kogyo Co., Ltd.) at 10,000 rpm for 10 minutes to give a homogenous mixed solution. In the mixed solution, 10 parts of dipentaerythritol hexamyristate was added, stirred and dissolved with a three-one motor.

(ii) Step I-2 (Preparation of an Aqueous Medium)

In an aqueous solution composed of 250 parts of ion exchanged water and 9.8 parts of magnesium chloride (a water-soluble polyvalent metal salt), an aqueous solution composed of 50 parts of ion exchanged water and 6.9 parts of sodium hydroxide (an alkali metal hydroxide) was gradually added with stirring to give a colloid of magnesium hydroxide (a colloid of hardly water-soluble metal hydroxide) dispersion.

(iii) Step I-3 (Preparation of Polymerizable Monomer for Shell)

A mixture of two parts of methyl methacrylate (Tg of its homopolymer shows=105° C.) and 65 parts of water was prepared to give an aqueous dispersion of polymerizable monomer for shell.

(iv) Step I-4 (Preparation of Droplets)

In the aqueous medium comprising magnesium hydroxide colloid prepared in step I-2, the polymerizable monomer mixture for core prepared in step I-1 was poured and stirred. Then, 1.75 parts of a molecular weight modifier (tert-dodecyl mercaptan), 0.25 part of a cross linking monomer (divinylbenzene) and six parts of a polymerization initiator (tert-butylperoxy-2-ethyl hexanoate, PERBUTYL® O, NOF Corp.) were poured and intensively sheared and stirred using an inline type emulsifying.dispersing apparatus (MILDER®, Ebara Corp.) at 15,000 rpm for eight minutes to give droplets of polymerizable monomer mixture for core.

(v) Step I-5 (Polymerization Step)

The aqueous dispersion comprising dispersed droplets of polymerizable monomer composition for core was placed in a reaction vessel equipped with stirring blades, heated to 85° C. and to start polymerization. The polymerization reaction was continued up to almost 100% polymer conversion. Then, an aqueous dispersion, which is prepared by dissolving 0.3 part of a water-soluble initiator [2,2'-azobis[2-methyl-N-(2-hydroxyethyl)propionamide, VA-086; Wako Pure Chemical Industries Ltd.] in the aqueous dispersion of the polymerizable monomer composition for shell prepared in step I-3, was added to the reaction vessel. The polymerization was continued for four hours, cooled to terminate the reaction to give a water dispersion comprising formed colored polymer particles having core-shell structure. The concentration of solid component in the aqueous dispersion of colored polymer particles was 27%. The residual amount of the monomer in the colored polymer particles before stripping treatment was determined.

2. Step II (Stripping Treatment Step)

The treatment system shown in FIG. 1 was used to carry out stripping treatment of the aqueous dispersion of the resultant colored polymer particles. The aqueous dispersion of colored polymer particles was diluted with ion exchanged water to make the concentration of solid component 25% and supplied to a vaporizer 1. Then, 0.1 part of a de-foaming agent with cloud point 36° C. (SN DEFOAMER® 180, San Nopco Ltd.) was added in the aqueous dispersion in the vaporizer 1. Nitrogen gas was surged in the vaporizer 1 to replace the space with nitrogen gas.

The aqueous dispersion was heated up to 80° C. by stirring with stirring blades 2, and a blower 4 was actuated to introduce nitrogen gas through a straight gas inlet tube 3 adjusting the flow rate at 0.6 $m^3$/hr·kg to carry out stripping of residual monomer from the aqueous dispersion.

After stripping, nitrogen gas was guided through a gas line 5 and successively to a condenser 6 and a condensing tank 7. After condensation, nitrogen gas was guided through a gas line 8 to a volatile substance removing apparatus (an absorption tower filled with active charcoal) 9 to remove volatile substances such as polymerizable monomer contained in the nitrogen gas. The nitrogen gas free from volatile substance is again blown in the vaporizer 1 through a circulation line 10 and gas blowing pipe 3 by a blower 4.

The stripping treatment was carried out for six hours under the conditions at about 80° C. of the aqueous dispersion of the colored polymer particles, at a pressure of 101 kPa in the vaporizer 1 and a nitrogen gas flow rate of 0.6 $m^3$/hr·kg.

After stripping treatment, determination of the amount of residual polymerizable monomer in the colored polymer particles showed concentration of 50 ppm or less. Thereafter the aqueous dispersion was cooled to 25° C.

3. Step III (Washing Step)

After stripping treatment step II, the aqueous dispersion of colored polymer particles was washed by addition of sulfuric acid with stirring (at 25° C. for 10 minutes) to adjust pH 4.5 or less.

Then, the aqueous dispersion was dehydrated and washed (water for washing at 25° C.) on a continuous belt filter (EAGLE FILTER®, Sumitomo Heavy Industries Ltd.), then, wet solid component was isolated. Ion exchanged water controlled at 25° C. was used as washing water and was sprayed on the wet cake placed on the belt at a rate of 36 kg/hour (total volume of water for washing=3-fold volume of the colored polymer particles).

4. Step IV (Step of Getting Colored Polymer Particles)

The wet solid component (moisture content=about 25%) obtained in the washing step was dried in a dryer at 45° C. for 10 hours to get colored polymer particles (core-shell structure colored polymer particles) with volume average particle diameter Dv=7.5 μm and particle diameter distribution Dv/Dp=1.19. The residual amount of polymerizable monomer in polymer particles after drying was determined.

In 100 parts of the gotten colored polymer particles, 0.8 part of hydrophobic silica with average particle diameter of 14 nm (RX200, Nippon Aerosil Co., Ltd.) was added and mixed with HENSCHEL MIXER to give a non-magnetic one component developer for electrostatic image development (a toner for electrophotography). The toner was evaluated on its imaging and the results are shown in Table 1.

Example 2

Colored polymer particles were obtained by a similar manner with those in Example 1 except for the changes of kind of nonionic surfactant and temperature of water for washing used in stripping step II as shown in Table 1 and a non-magnetic one component developer (toner) was prepared. The results are shown in Table 1.

Example 3

Colored polymer particles were obtained by a similar manner with those in Example 1 except for the changes of kind of nonionic surfactant and temperature of water for washing used in stripping step II as shown in Table 1 and a non-magnetic one component developer (toner) was prepared. The results are shown in Table 1.

Comparative Example 1

Colored polymer particles were obtained by a similar manner with those in Example 1 except for the changes of kind of nonionic surfactant and temperature of water for washing used in stripping step II as shown in Table 1 and a non-magnetic one component developer (toner) was prepared. The results are shown in Table 1.

TABLE 1

| | Example | | | CompEx |
|---|---|---|---|---|
| | 1 | 2 | 3 | 1 |
| Nonionic SN | SN | SN | SN | SN |
| DEFOAMER® | DEFOAMER® 180 | DEFOAMER® 444 | DEFOAMER® 265 | DEFOAMER® 265 |
| Added amount (part) | 0.1 | 0.1 | 0.1 | 0.1 |
| Cloud point (° C.) | 36 | 28 | 15 | 15 |
| Temperature of Washing water (° C.) | 25 | 15 | 10 | 25 |
| Amount of residual polymerizable monomer (ppm) | | | | |
| Before stripping | 640 | 640 | 640 | 640 |
| After stripping & drying | 13 | 12 | 15 | 15 |
| Amount of residual nonionic surfactant (ppm) | 13 | 12 | 30 | 304 |
| Characteristic features of toner | | | | |
| Charge level (μC/g) | | | | |
| N/N environment | 39.8 | 40.2 | 37.9 | 30.2 |
| H/H environment | 35.2 | 33.4 | 34.1 | 18.6 |
| Evaluation of Images | | | | |
| Image density | 1.43 | 1.42 | 1.44 | 1.46 |
| Fog | | | | |
| N/N environment | 0.2 | 0.2 | 0.3 | 3.5 |
| H/H environment | 0.9 | 0.8 | 1.1 | 12.8 |

Comparative Example 2

Polymerization and stripping treatment were carried out in a similar manner with those of Example 1 except for without addition of nonionic surfactant in stripping treatment step II in Example 1. However, the treatment was discontinued because of vigorous foaming on the surface of solution.

Comparative Example 3

Polymerization and stripping treatment were carried out in a similar manner with those of Example 1 except for a silicone de-foaming agent (SM5515; a silicone oil, Dow Corning Toray Silicone Co., Ltd.) was used instead of a nonionic surfactant DEFOAMER® 180 in stripping treatment step II in Example 1. Thereafter, washing with water at 35° C., recovery treatment and preparation of electrophotographic toner by a conventional method were carried out.

The toner prepared by above mentioned method showed low charge level of 19.1 μC/g and intense fog of 5.6 under N/N environment. Furthermore no uniform image density was found. No improvement was found despite of lowered temperature of washing water to 25° C.

INDUSTRIAL APPLICABILITY

According to the present invention, a process for producing a polymerized toner having excellent characteristic features of toner accompanied with marked reduction of residual volatile organic compounds such as unaltered polymerizable monomer is provided. The present invention provides a process for producing a polymerized toner exhibiting excellent characteristic features of toner, by subjecting an aqueous dispersion comprising a colored polymer particles obtained by polymerization to stripping treatment in the presence of a nonionic surfactant having a cloud point to markedly remove a volatile organic compound such as polymerizable monomer, and also markedly remove a residual nonionic surfactant which works as a de-foaming agent.

The polymerized toner produced by the present invention can be used as a developer to visualize electrostatic latent images formed on a photosensitive element in copy machines such as electrophotography and electrostatic recording system, and image forming devices such as laser beam printer and facsimile.

What is claimed is:

1. A process for producing a polymerized toner comprising producing colored polymer particles, which includes a binder resin which is obtained by polymerizing a polymerizable monomer in an aqueous medium and comprises at least a colorant dispersed therein, by polymerization step optionally followed by agglomeration step, wherein the process comprises the following steps (I) to (IV):

(I) forming an aqueous dispersion comprising the colored polymer particles by the polymerization step optionally followed by agglomeration step;

(II) subjecting the aqueous dispersion comprising the colored polymer particles obtained in step (I) to stripping treatment in the presence of a nonionic surfactant having a cloud point to remove a volatile organic compound which is included in the colored polymer particles;

(III) dehydrating and washing the aqueous dispersion comprising the colored polymer particles after the stripping treatment, wherein washing is carried out by using a washing water, wherein the temperature of the washing water is controlled to lower than the cloud point of the nonionic surfactant; and (IV) filtering the aqueous dispersion comprising the colored polymer particles after washing to obtain a wet colored polymer particles, drying the wet colored polymer particles and then getting the colored polymer particles.

2. The process according to claim 1, wherein in the step (II), the stripping treatment is carried out in the presence of the nonionic surfactant having a cloud point by adding the nonionic surfactant to the aqueous dispersion comprising the colored polymer particles obtained in step (I).

3. The process according to claim 1, wherein in the step (II), the nonionic surfactant is polyether nonionic surfactant.

4. The process according to claim 3, wherein the polyether nonionic surfactant is polyalkyleneglycol nonionic surfactant.

5. The process according to claim 4, wherein the polyalkyleneglycol nonionic surfactant is polyethylene glycol nonionic surfactant, polypropylene glycol nonionic surfactant or polyethylene glycol/polypropylene glycol nonionic surfactant.

6. The process according to claim 1, wherein the cloud point of the nonionic surfactant is at 5 to 80° C.

7. The process according to claim 1, wherein in the step (II), an aqueous dispersion, which comprises a colored polymer particles having a concentration of solid component of 5 to 45% by weight, is subjected to the stripping treatment in the presence of 0.01 to 1 part by weight of the nonionic surfactant per 100 parts by weight of the colored polymer particles.

8. The process according to claim 1, wherein in the step (II), the stripping treatment of the aqueous dispersion comprising the colored polymer particles is carried out at a temperature of not lower than the glass transition temperature, Tg, of a polymer component constructing said colored polymer particles to lower than 100° C.

9. The process according to claim 1, wherein in the step (II), the stripping treatment is carried out by supplying the aqueous dispersion comprising the colored polymer particles in a vaporizer, adding the nonionic surfactant having a cloud point to the aqueous dispersion, and then conducting stripping treatment under a pressure of the vaporizer of 5 to 105 kPa by a reduced pressure stripping method, a bubbling method, or a method in which the reduced pressure stripping method is carried out during blowing a gas thereinto.

10. The process according to claim 1, wherein in the step (II), the stripping treatment is carried out by supplying the aqueous dispersion comprising the colored polymer particles in a vaporizer, adding the nonionic surfactant having a cloud point to the aqueous dispersion, adjusting a temperature of the aqueous dispersion to not lower than the glass transition temperature, Tg, of a polymer component constructing the colored polymer particles to lower than 100° C., and then blowing a gas into the aqueous dispersion under a pressure of the vaporizer of 5 to 105 kPa.

11. The process according to claim 10, wherein the gas is blown into the aqueous dispersion at a flow rate of 0.05 to 2 $m^3/(hr \cdot kg)$.

12. The process according to claim 1, wherein washing is carried out with a washing water at a temperature of which is controlled to such that a temperature difference, A−B, wherein A is a temperature of cloud point of the nonionic surfactant and B is a temperature of the washing water, is not less than 10° C.

13. The process according to claim 1, wherein in the step (IV), a colored polymer particles, which comprises a residual polymerizable monomer in a proportion of less than 100 ppm, is gotten.

14. The process according to claim 1, wherein in the step (IV), a colored polymer particles, comprises a residual nonionic surfactant in a proportion of less than 100 ppm, is gotten.

15. The process according to claim 1, wherein in the step (I), the aqueous dispersion comprising the colored polymer particles is formed by suspension polymerization of a polymerizable monomer composition comprising at least a colorant and a polymerizable monomer in an aqueous medium comprising a dispersion stabilizer.

16. The process according to claim 1, wherein in the step (I), an aqueous dispersion comprising a colored polymer particles of core-shell structure is formed by suspension polymerizing a polymerizable monomer composition comprising at least a colorant and a polymerizable monomer in an aqueous medium comprising a dispersion stabilizer to form a colored polymer particles, and then polymerizing a polymerizable monomer for shell in the presence of the colored polymer particles.

17. The process according to claim 1, wherein in the step (IV), a colored polymer particles, which has a volume average particle diameter of 3 to 10 μm and a particle diameter distribution, defined as the ratio of volume average particle diameter, $D_v$, to the number average particle diameter, $D_p$, of 1.3 or less and comprises a residual polymerizable monomer in a proportion of 30 ppm or less and a residual nonionic surfactant in a proportion of 50 ppm or less, is gotten.

* * * * *